United States Patent [19]

Frankman

[11] 3,947,635

[45] Mar. 30, 1976

[54] INTEGRATED STEREO SPEAKER SYSTEM

[76] Inventor: Charles W. Frankman, 758 Washington Ave., Greenville, Ohio 45331

[22] Filed: Sept. 12, 1973

[21] Appl. No.: 396,484

[52] U.S. Cl. ..... 179/1 E; 179/1 GA; 181/144

[51] Int. Cl.[2] ..... H04R 5/02

[58] Field of Search ..... 179/1 G, 1 E, 1 GA; 181/31 B, 100.1 TD, 144, 145, 148, 154, 156, 199

[56] References Cited

UNITED STATES PATENTS

| | | | |
|---|---|---|---|
| 2,710,662 | 6/1955 | Camras | 179/1 GA |
| 2,994,399 | 8/1961 | Zimmerman | 181/31 B |
| 3,016,424 | 1/1962 | Franke | 179/1 G |
| 3,340,956 | 9/1967 | Owen | 181/31 B |
| 3,491,204 | 1/1970 | Sherno | 181/145 |
| 3,582,553 | 6/1971 | Bose | 181/31 B |
| 3,648,801 | 3/1972 | Huszty | 181/31 B |
| 3,734,053 | 5/1973 | Dodge | 181/31 B |

FOREIGN PATENTS OR APPLICATIONS

| | | | |
|---|---|---|---|
| 1,309,417 | 1962 | France | 181/31 B |

OTHER PUBLICATIONS

Loudspeakers For Stereo (Part II), by Crowhurst, Electronics World, May, 1959, pp. 42, 43, 44, 126, 127.

A Corner-Mounting Infinite Baffle by Kiebert, Audio Engineering, Oct., 1952, pp. 32, 33.

*Primary Examiner*—Douglas W. Olms

*Attorney, Agent, or Firm*—Jerome P. Bloom

[57] ABSTRACT

An integrated stereo speaker system in which substantially non-directional bass sounds of low frequency are supplied exclusively to an enclosure common to right and left channels. Directional sounds in mid-range and higher frequencies are supplied to separated right and left treble speaker means with respect to which the common bass enclosure is preferably in a co-planar central position. Drivers within the common bass enclosure are mounted to minimize vibration effects and to obviate standing wave and bass cancellation effects. Treble speaker means may comprise multiple drivers related to each channel which occupy a vertical polarized axis for minimal distortion and best stereo effect.

6 Claims, 8 Drawing Figures

FIG-2
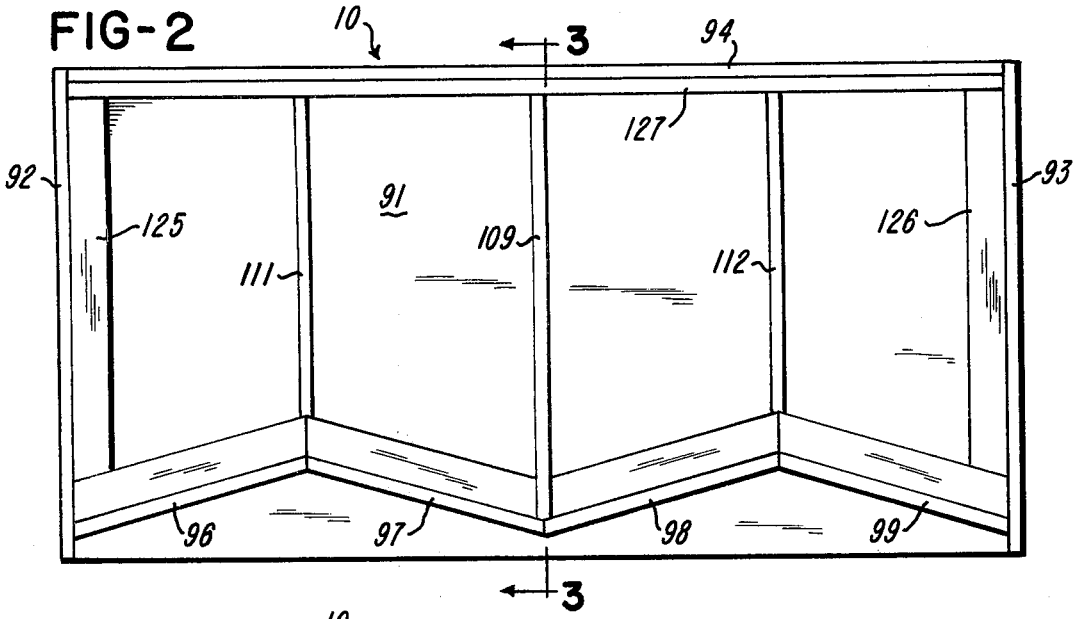
FIG-3
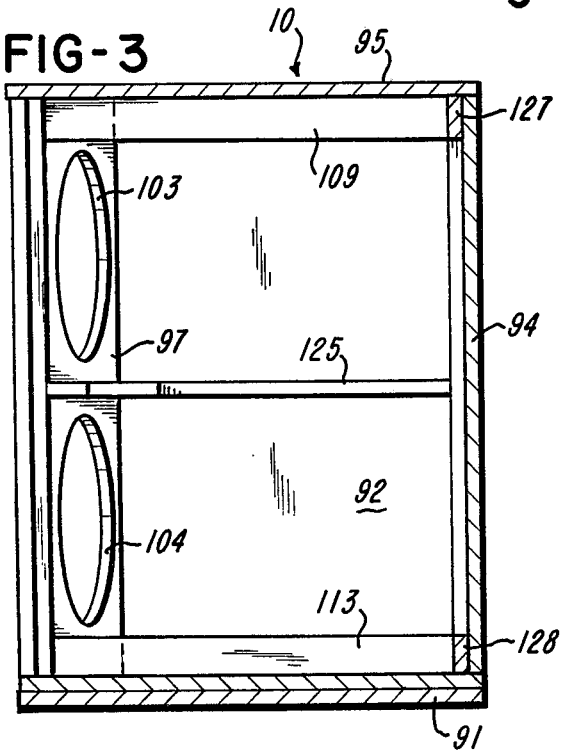
FIG-6
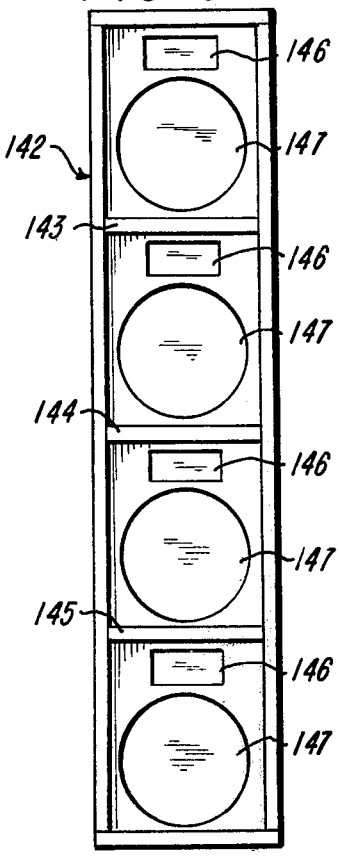
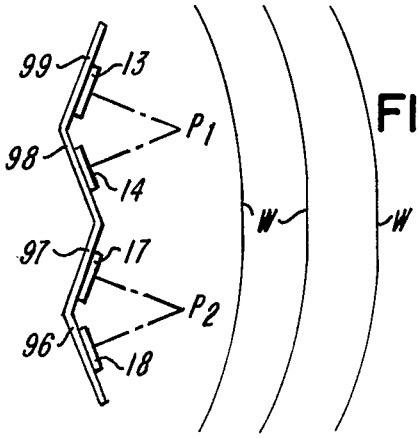
FIG-7

INTEGRATED STEREO SPEAKER SYSTEM

BACKGROUND OF THE INVENTION

This invention relates to stereo speaker systems, and particularly to systems combining effective bass reproduction with directional stereo response at higher level frequency ranges.

Sound reproduction systems of the prior art have been compelled to deal in compromise fashion with directional and non-directional characteristics of sound waves of differing frequency. Two full range monophonic speakers give incomplete stereo response since they do not deal adequately with directional and non-directional sounds. Bass sounds or sounds at the low range of the frequency scale are substantially non-directional since a listener does not readily detect pressure differentials. When the monophonic speakers are separated for good spacial stereo response many bass sounds are largely unheard because of bass cancellation. This occurs when, for example, there are two separated speaker enclosures each producing identical sound pressure waves primarily in respect to the bass notes involved. As these waves move out, they intersect and in part merge. The usual result is that the maxima pressure wave of one speaker enclosure merges with the minima wave produced from the other. At their points of intercept there is a cancellation of the bass notes.

If the speakers are placed side by side in the listening room, the bass response is improved but at the expense of stereo separation.

Proper placement of the speakers accordingly becomes a compromise in which both bass response and stereo effect are to a degree sacrificed.

Also, in the prior art, excessive vibration in the speaker enclosures has been a problem, to the extent that record turntable components cannot be mounted on a speaker enclosure without vibrating the relatively lightly weighted pickup arm out of a record groove. Moreover, any vibration of a speaker enclosure while reproducing a bass note is exactly 180° out of phase to the movement of the driver cone. This out of phase characteristic distorts the true wave form of the bass note and impairs the acoustical output power of the speaker.

A further problem exists in respect to standing waves. When a bass sound, for example, a low range musical note, leaves a speaker placed squarely along a wall it travels across the room, strikes the opposite wall, and is reflected back toward the speaker. The two waves, the direct and reflected, are 180° out of phase with each other, causing standing waves which produce null or dead areas in a room, the locations of which depends on frequencies involved and the size and configuration of the room.

SUMMARY OF THE INVENTION

The instant invention differentiates between sounds of a directional and non-directional nature and utilizes speakers of specifically different range reproduction. The speakers are, moreover, arranged for optimal listening, with sounds of treble and overtone range being delivered from satellite or spaced speaker means while bass drivers of both right and left channels are brought together in a common speaker enclosure and located centrally of the spaced speaker means. Bass sounds, or sounds at a low end of the frequency scale, are delivered exclusively through the common bass enclosure.

Treble and overtone sounds are delivered exclusively through the satellite speakers. The common base enclosure provides sound which is constant throughout the listening area and which does not interfere with directional, stereo effect sound in treble and overtone ranges. In the common base enclosure the driver axes of the different channels are brought close together to unify the bass sounds, enabling the drivers to work together. Sound from the drivers is blended to produce substantially a single wave length of sound in the low frequency range. Further, drivers within the common bass enclosure are placed in positions of relative angularity such that standing wave effects and bass cancellation may be avoided. Panels mount drivers within the bass enclosure and are in turn supported by a lattice work of bracing means imparting rigidity to the speaker structure without inhibiting natural sound reproductions. The common bass enclosure accordingly is vibration free to a degree allowing record turntables to be mounted directly thereon.

According to a feature of the satellite speakers, the treble and overtone drivers thereof are mounted in a vertically stacked relation causing sound to emerge therefrom in a single plane. Multiple driver components in either the right or left channel satellite speaker may similarly be polarized in a vertical plane, offering in combination with the common bass enclosure the means to enjoy full range, high quality sound reproduction.

An object of the invention, in a stereo speaker system, is to deliver both good bass reproduction and spacial stereo response.

Another object of the invention is to deliver unified bass sounds in a stereo system exclusively through a common bass enclosure.

Another object of the invention is to deliver sounds in a treble and overtone range on the frequency scale through separated satellite speakers in stereo relation and with respect to which unified bass sounds are delivered independently from a central source.

Still another object of the invention is to provide a common bass enclosure in which driver components are mounted in a position of angularity obviating standing wave effects.

A still further object of the invention is to provide a bass enclosure in which driver components are supported in a manner positively to suppress vibration within the enclosure.

Still another object of the invention is to provide satellite stereo speaker means in which individual driver components are in a polarized axis in a vertical plane of orientation.

A still further object of the invention is to reduce both intermodulation distortion and doppler effects.

With the above and other incidental objects in view as will more fully appear in the specification, the invention intended to be protected by Letters Patent consists of the features of construction and of the parts and combinations thereof, as hereinafter described or illustrated in the accompanying drawings, or their equivalents.

Referring to the accompanying drawings, wherein is found one but not necessarily the only form of embodiment of the invention;

FIG. 2 is a view similar to FIG. 1, but taken from the top of the enclosure with the top removed and with a lattice-work bracing within the enclosure partially omitted;

FIG. 3 is a view in cross section, taken substantially along the line 3—3 of FIG. 2;

FIG. 6 is a detail view of satellite speaker means wherein drivers are arranged in a single vertical plane; and FIG. 7 is a diagram illustrating sound wave effects as produced by the common bass enclosure of the invention.

Figure 1:
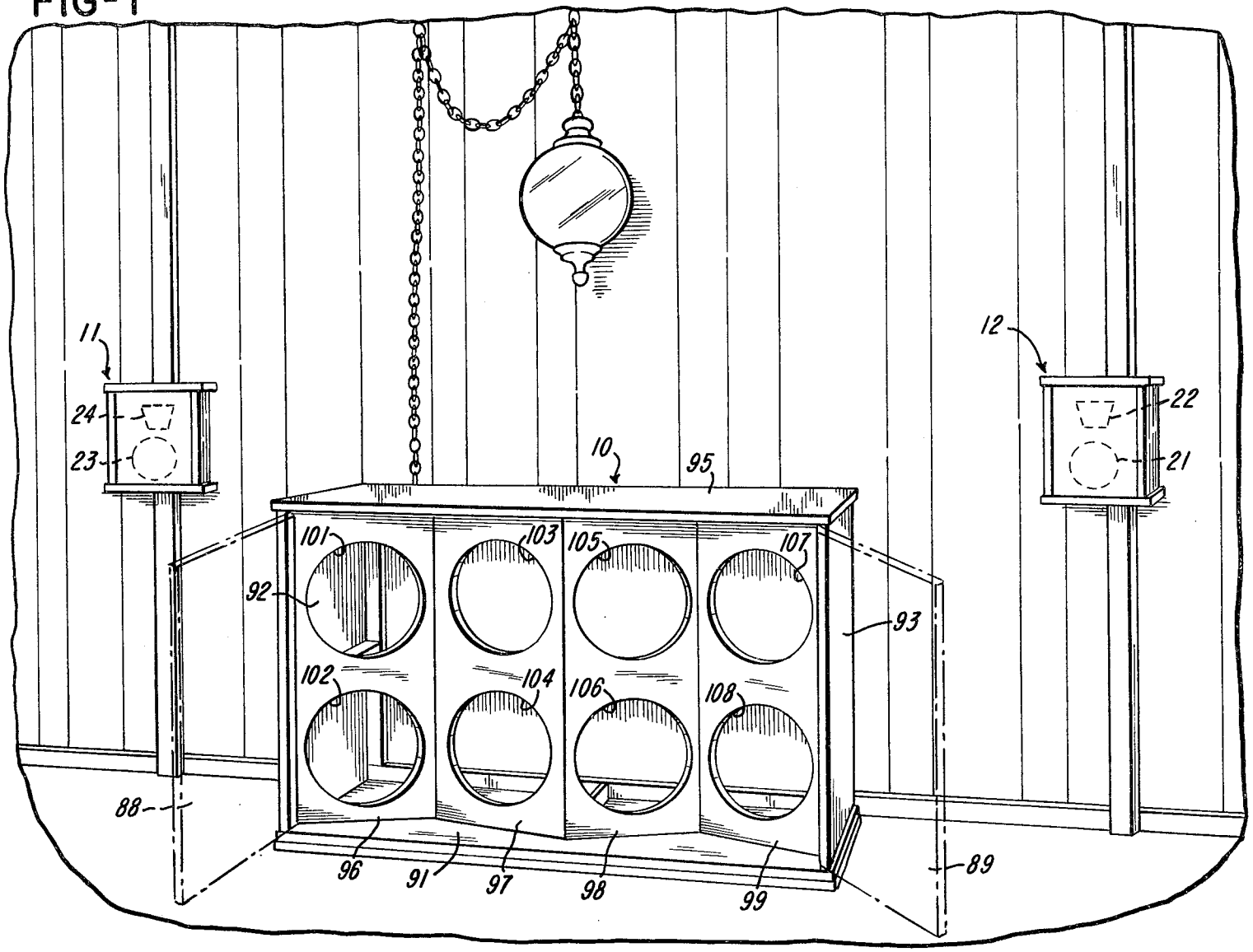
FIG. 1 is a view in perspective of a speaker stereo system in accordance with the illustrated embodiment of the invention featuring a common bass enclosure shown in partly diagrammatic form in front elevation, with front doors of the enclosure being removed and with driver components being omitted.

Referring to the drawings, an integrated stereo speaker system in accordance with the illustrated invention embodiment comprises a floor mounted console cabinet 10 which, as will be seen, constitutes a common bass enclosure through which all sounds in the low range of the frequency scale are delivered, in both right and left channels. Ranging to either side of the enclosure 10 in a co-planar relation thereto, are relatively smaller table mounted or wall mounted speaker means 11 and 12. The latter, as will be seen, are connected to deliver sounds in treble and overtone range frequency in respective left and right channels. The system accordingly provides for emergence of low frequency substantially non-directional sound from a common bass enclosure and for emergence of higher frequency, directional sound from satellite speakers in a separated relation to one another and in a flanking relation to the enclosure 10.

It may be commented in connection with the foregoing that the human ear does not determine source direction by instantaneous pressure differential, but by phase angle measurement, that is, by noting the delay in intercept of maxima and minima of sound waves at one ear and at the other. It is a time function process. When one ear distinguishes a difference in pressure over the other, the brain translates this into direction. However, bass notes, which can be defined as any note below 200 on the Hertz frequency scale, are substantially non-directional. For example if a note is a low 8 -foot wave length (136 HZ) the gap between the two different sound pressures is 4 feet, approximately three and one-half feet longer than the distance between the ears. With this note or sound, no direction is detected because of the inadequacy of the pressure differential at the ears. In accordance with the instant invention, as illustratively indicated in FIG. 1, stereo spacial response is not impaired but rather is actually improved. The relatively non-directional bass notes remain constant throughout the listening area and do not interfere with the directional stereo-producing treble and overtone ranges. A system delivering both good bass reproduction and spacial stereo response is a basic objective of the present invention, as has been indicated.

In diagram form, the common bass enclosure 10 mounts four bass drivers 13–16 associated with right channel delivery and four like drivers 17–20 associated with left channel delivery. Right channel satellite speaker means 12 includes a treble driver 21 associated with treble frequency sounds and an overtone driver 22 associated with sounds in the overtone range. Satellite speaker means 11 comprises like means in the form of treble driver 23 and an overtone driver 24 orienting and serving the same purpose as members 21 and 22 but in conjunction with the left channel delivery. The drivers of the system are appropriately connected in an electrical circuit through which electrical energy capable of initiating the appropriate sound waves is distributed from a stereophonic amplifier 25. A connection plate 26 on the amplifier 25 has right channel terminals 27 and 28 and left channel terminals 29 and 31. From the former, conductors 32 and 33 lead through an intermediate connection means 34 to a right network connection plate 35. In like manner, conductors 36 and 37 extend from left channel terminals 29 and 31 through intermediate connection means 34 to a left channel network connection plate 38. The plate 35 has a pair of in-coming terminals 39 and 41 to which the conductors 32 and 33 attach, and, further, has separate sets of out-going terminals 42–43 and 44–45 which lead respectively to right channel bass drivers 13–16 and right channel treble and overtone drivers 21 and 22. In a manner which it is unnecessary here to consider, terminals 39 and 41 are appropriately wired to terminals 42–43 and terminals 44–45 to supply sounds of low frequency, as for example below 200 HZ, to terminals 42–43 and to supply sounds above the 200 HZ value to terminals 44–45. At connection plate 38, like in-coming terminals 46–47 supply low frequency sound to out-going bass terminals 48–49 and supply upper frequency sounds to out-going upper range terminals 51–52 effectively to feed a left channel network. The right channel network supplies bass drivers 13–16 through conductors 53–54 achieving a bridging relation, in substantially parallel fashion, to the several bass drivers of the right channel. Higher range output terminals 44–45 connect through conductors 55 and 56, and through intermediately positioning connection plates 57 and 58 to a further network distributing connection plate 59 associated with the right channel satellite speaker 12. The plate 59 provides input terminals 61 and 62 and sets of output terminals 63–64 and 65–66. In a manner which it is again unnecessary here to consider, the in-coming signal at terminals 61–62 is split into treble and overtone range frequencies with the former being supplied to terminals 63–64 and the latter being supplied to terminals 65–66. Conductors 67 and 68 lead from terminals 63–64 to the treble driver 21. Conductors 69 and 71 lead from terminals 65–66 to overtone driver 22. The left channel network supplies the bass drivers 17–20 through conductors 70 and 80 achieving a bridging relation, in substantially parallel fashion, to the several bass drivers of the left channel. In the case of the left channel satellite speaker means, conductors 72 and 73 lead through intermediate attachment means 74 and 75 to network distributing connector plate 76. There input or in-coming terminals 77–78 supply treble terminals 79 and 81 and overtone terminals 82 and 83 with the former being connected by conductors 84 and 85 to treble driver 23 and the latter being connected by conductors 86 and 87 to overtone driver 24.

The system accordingly is one to accept signals from the stereophonic amplifier 25 and to direct all bass sounds or notes to drivers the axes of which are in such relative adjacent relation as to bring about a blending or unifying of emitted sound. At the same time, higher frequency sounds are delivered to relatively separated left and right channel speaker means each of which is in turn structured for separate emission of treble and overtone sounds.

Figure 4:
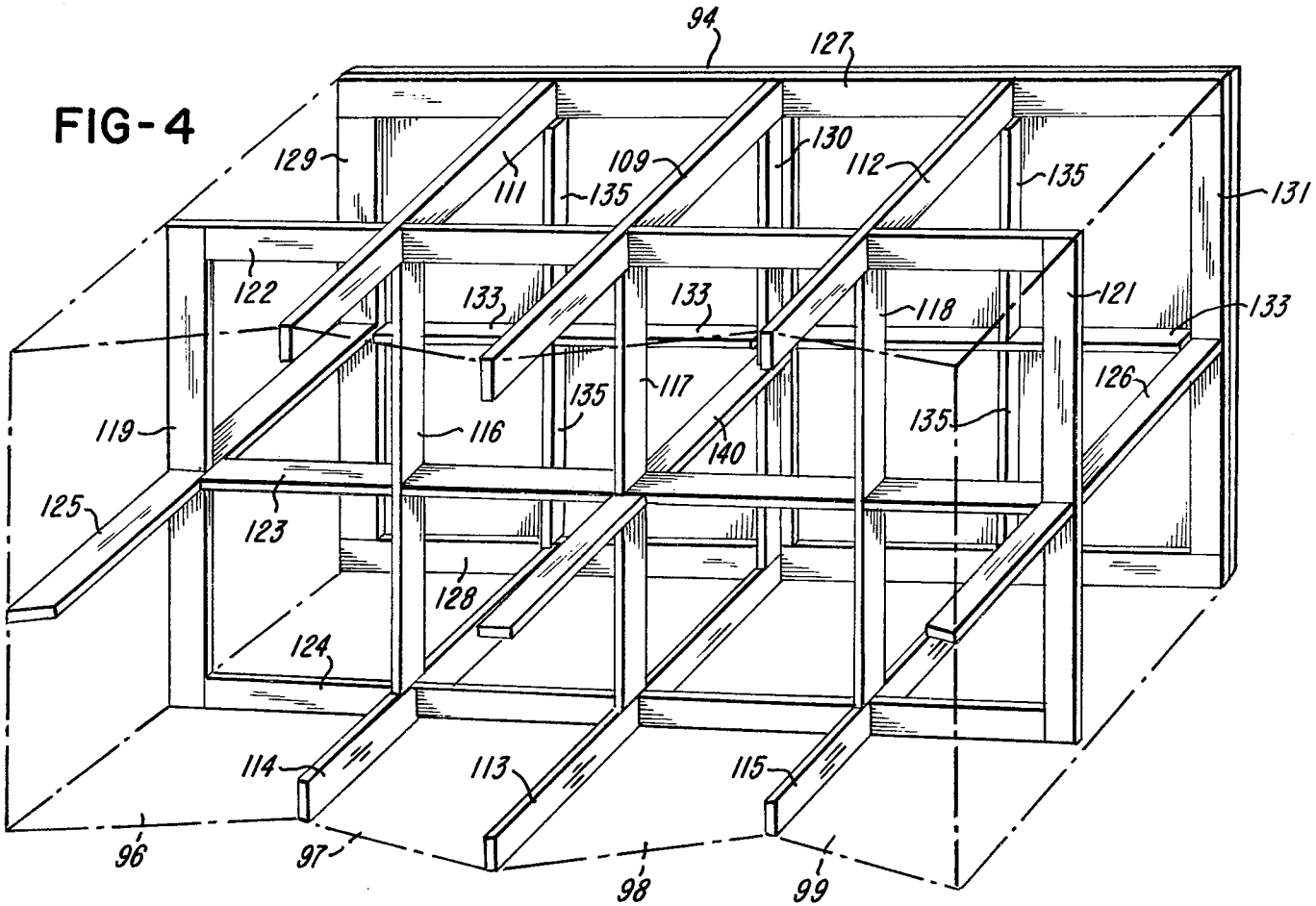
FIG. 4 is a detail view in perspective of a system of lattice-work bracing comprised in the common bass enclosure.

The bass enclosure 10 is common to the right and left channel sets of bass drivers 13–16 and 17—20, the sets of drivers being received in the enclosure to face generally to the front thereof, which front has doors 88 and 89. The bass enclosure is further constructed, as shown in FIGS. 2, 3, and 4, to provide a base or floor 91, upstanding side walls 92 and 93, a back wall 94, and a top 95. Upstanding in the enclosure and substantially filling the front thereof are four panels 96, 97, 98 and 99, adjacent panels having substantially contiguous edges. The panels extend from top to bottom of the enclosure, and, in assembly, extend from side to side thereof and are offset toward the front of the enclosure. Still further, the panels are placed at an angle to the front of the enclosure, the angle in the illustrated instance being on the order of 15°. Adjacent panels, moreover, are set to opposing positions of angularity to occupy a convergent-divergent relationship to one another. In the panel 96 are upper and lower driver openings 101 and 102. In the several panels 97, 98 and 99 are like, corresponding sets of openings 103–104, 105–106, and 107–108 respectively. The pair of adjacent panels 98 and 99 may be regarded as mounting right channel bass drivers 13–16, while the pair of adjacent panels 96–97 may be regarded as mounting left channel bass drivers 17–20. The several drivers are, as will be understood, accommodated in respective openings 101–108 to face to the front of the enclosure. In mounting the drivers within panel openings they are caused to occupy a position of parallelism with respect to the panels in which they are received. Accordingly, the bass drivers occupy the same position of angularity with respect to the front of the enclosure and to one another as do the mounting panel 96–99.

The driver mounting panels 96–99 achieve, as noted, a substantially closing relation to the front of the common bass enclosure. In supporting relation to the rear thereof is a lattice-work of ribs which include a top rib 109 centrally positioned in the enclosure and extending from back wall 94 to the junction of driver mounting panels 97 and 98. As indicated in FIG. 4, the top rib 109 is one of a series of laterally spaced apart upper ribs which further include ribs 111 and 112 to either side of the rib 109 and which respectively support panels 96 and 97 at the junction thereof and panels 98 and 99 at the junction thereof. Still further, as shown in FIG. 4, the lattice-work of ribs includes bottom ribs 113, 114 and 115 which occupy corresponding positions to the ribs 109, 111 and 112 and similarly cooperate in backing up the panels 96–97 and 98–99. Other ribs include segmented vertical ribs 116, 117 and 118 interconnecting top and bottom ribs. Other vertical ribs 119 and 121 at the sides of the enclosure are joined by segmented transverse ribs 122, 123 and 124 as well as by horizontally disposing side ribs 125 and 126 and central rib 140. At the back of the enclosure are upper and lower horizontal ribs 127 and 128 interconnected by vertically disposing side ribs 129 and 131 and central rib 130. Intersecting ribbing 133 and 135 is applied to rigidify the back 94 of the bass driver enclosure as shown in FIG. 4. The several ribs and segments of ribs are joined to one another in a suitable bonding or like process and constitute, as will be evident, a substantially rigid framework joining structural walls of the enclosure to one another and providing positive support for the driver mounting panels. The ribs provide limited open space within the enclosure, in the illustrated instance no more than one square foot of open space at any interior location. They act as a vibration preventing means and inhibit swelling and contraction of the walls of the enclosure as may contribute to loss of audio output and other undesirable results. Moreover, with the substantial elimination of vibration effects, a record turntable maybe mounted directly upon the top of the bass enclosure 10 without fear that tracking of the lightly weighted pickup arm in the record groove will be adversely affected.

In the satellite speaker means 11, the treble driver 23 and overtone driver 24 are mounted to orient in a position of vertical alignment. In the satellite speaker means 12 is a similar orientation of driver 21 and overtone driver 22. The emerging sound at the satellite speakers accordingly is polarized in a vertical plane. Treble and overtone sounds are delivered separately but blend with single pressural effect on the ears of the listener.

Figure 5:
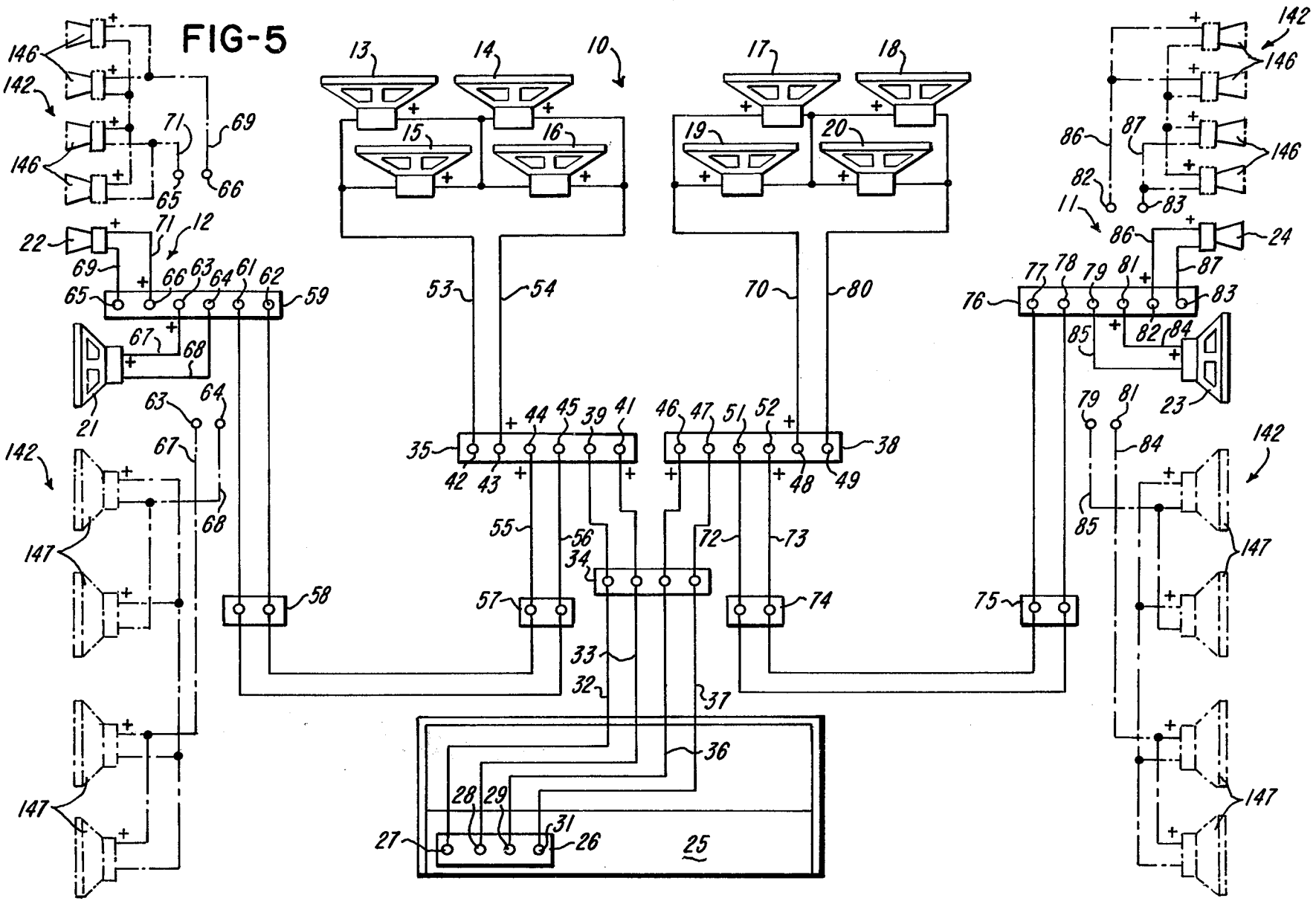
FIG. 5 is a diagrammatic view of a speaker system, wherein the satellite speakers may embody plural drivers in common vertical planes, connections from a stereophonic amplifier being diagrammatically indicated and 5*a* is a schematic illustrating the network arranged for each channel, which is identical.
Figure 5A:
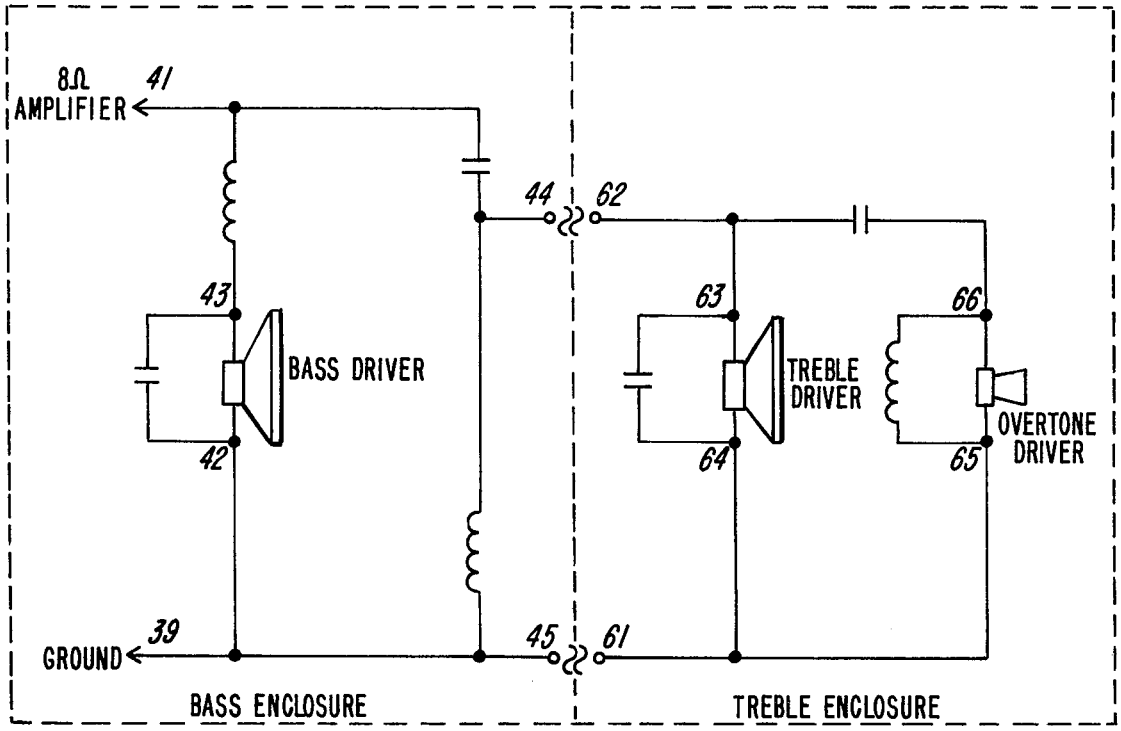

As indicated in FIG. 6, the concept of vertical polarized speaker means for the satellite speakers may be carried out using multiple drivers, in a preferred embodiment. As shown in FIG. 6, a vertically elongated enclosure 142 is divided by partitions 143, 144 and 145 into vertically stacked driver units. In each unit is an overtone driver 146 and a treble driver 147 mounting vertically of one another in the same manner as the overtone and treble driver elements considered in connection with the satellite speaker means 11 and 12. FIG. 5 also shows schematically a modification of the invention embodiment utilizing a multiplicity of satellite drivers for each channel, per FIG. 6, whereby the drivers are polarized in a vertical plane. The application of this modification in the basic circuit in lieu of the drivers shown is believed obvious.

The invention combines the base drivers of stereo channels in a single enclosure, the several drivers being brought into a closely assembled relation in a manner substantially to unify their axes to cause the drivers to work together. They blend emitted sound to produce substantially a single sound wave. As before noted, the phenomena of standing wave effects and base cancellation are obviated. Contributing to this result is the angular mounting of the bass drivers which, in accordance with the illustrated embodiment of the invention, mount at a 15° angle to the front of the enclosure. The opportunity for reflected waves which cause standing waves to reach a condition out of phase with one another is avoided. Conditions conducive to standing wave effects in the listening area as well as inside the common base enclosure itself are minimized before they can be created.

The drivers used for all three ranges, that is, bass range, treble range and overtone range, are all matched to reproduce exactly the same sound pressure levels for the same voltage input. Therefore, notes reproduced by the bass drivers have exactly the same volume level as notes reproduced by the treble or overtone drivers. This results in a total frequency response of plus or minus 4 decibels from 28 to 18,750 HZ, at a sound pressure level of 110 decibels. Satellite speaker means are provided with a critical acoustical cutoff at 200 HZ to avoid duplication of sounds produced by function of the bass speaker enclosure. As a result intermodulation and Doppler distortion are avoided.

Driver mounting panels 96–99 may be regarded as having baffle functions. The common bass enclosure, of which they are a part, is a completely closed unit of an infinite baffle type. In a typical, though not necessarily limited, construction thereof, the enclosure houses eight 12 inch drivers, four per channel, and has a volume of 16.10 cubic feet. This meets the law of physics in producing a pure 32.70 HZ note, low C. With 600 square inches of speaker cone area it can reproduce all notes from low C up to the 200 HZ cross over at intensities of 110 decibels.

As heretofore noted, any vibration of a speaker enclosure while reproducing a bass note is exactly 180° out of phase to the movement of the driver cone. This out of phase characteristic distorts the true wave form of that bass note and impairs the acoustical output of the speaker. Within the instant common bass enclosure is a wall to wall, top to bottom, front to back, three dismensional latticed brace. The largest unbraced surface is in the illustrated instance on the order of 122 square inches. The provided three-dimensional bracing lattice eliminates all vibrations of the enclosure.

A particularly unique aspect of the invention lies in the construction of the common bass enclosure. Such construction has among its results, as has been noted, a bringing together of bass drivers of different channels as to blend emitted sound in a matter the effect of which is to produce substantially a single sound wave.

Contributing to this, as indicated in FIG. 7, is the relative angularity and immediate connection of the driver mounting panels 96–99. The drivers of adjacent pairs of mounted drivers, as for example drivers 13–14 and drivers 17–18, are in a convergent-divergent relation so that emitted sound has a focal point relatively closely adjacent the front face of the enclosure. Thus right channel drivers 13 and 14 produce sound intersecting at a point $P_1$, while left channel drivers 17–18 produce sound intersecting at a point $P_2$. The focal points, due to side by side relation of the channels, are so closely spaced that the emitted sound from the respective channels in effect blend as they move outward, the effect of which is to produce a substantially single composite wave W. In this fashion the bass sounds of the separate channels are blended so as to become uniformly audible throughout the full wave length. Thus, the angular disposition of the driver mounting panels insures a blending of sounds from the separate drivers of each channel and provides further for a bringing of the outputs of respective channels into a closely adjacent relation to reinforce each other. The angularity of the mounting panels determines the distance to the front of the enclosure at which points $P_1$ and $P_2$ occur and therefore the origin or starting place of unified wave W.

In the prior art, separate sound waves are produced by each speaker which move outwardly independently of one another and achieve a complementary relation and produce true sound only at limited positions between the speakers. Moreover, not only is full power sound heard only in limited areas between the speakers, other points and regions are created in which bass cancellation effects cause some sounds to be heard imperfectly or not at all. The instant invention obviates the described bass cancellation effects and at the same time gives a blended, powerful bass sound uniform throughout the room in which the apparatus is contained.

From the above description it will be apparent that there is thus provided a device of the character described possesssing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

What is claimed is:

1. An integrated stereo speaker system supplying multi-channel amplified sound deriving from a stereo production, including a bass speaker enclosure and relatively separated right and left upper range satellite speaker means, said bass speaker enclosure embodying a plurality of bass speaker means arranged to exclusively receive all sound waves from said channels which are in a low frequency range, and means for providing that the sound waves in a treble range and an overtone range in the respectively different channels are supplied exclusively to said right and left upper range speaker means, said bass speaker means including a pair of speakers for each channel, said speakers being paired to have the central axes of each pair converge in a direction outwardly of said enclosure and the pairs of speakers being mounted in such side by side relation that the sounds from the respective paired speakers, each pair of which is adapted to transmit sounds from a single channel, blend to produce substantially a single wave length of sound, in the low frequency range.

2. An integrated stereo speaker system according to claim 1, wherein each of said upper range speaker means includes separate drivers respectively and individually supplied with treble and overtone sounds.

3. An integrated stereo speaker system according to claim 1, wherein each upper range speaker means comprises a plurality of speaker enclosures, and wherein said upper range speaker enclosures each embody a separate driver and said enclosures in each said upper range speaker means are placed in line so that the drivers therein are arranged in a vertical plane.

4. An integrated stereo speaker system according to claim 1 characterized by said bass speaker enclosure including a wall portion embodying sections in the form of panels arranged in side by side paired relation, the panels of each pair thereof being angularly related and mounting said bass speakers in their paired side by side relation in arrangement providing that the low frequency sound delivered from each channel by way of said bass speakers has a focal point a selected distance from said enclosure and the focal points deriving from different channels are established in a relatively closely adjacent relation to blend the emitted sound to produce substantially a single wave length of sound in the said low frequency range.

5. An integrated stereo speaker system supplying multi-channel amplified sound deriving from a stereo production, including a bass speaker enclosure embodying a plurality of bass speaker means arranged to exclusively receive all sound waves from said channels which are in a low frequency range, said bass speaker means including a pair of speakers for each channel, said speakers being paired to have the central axes of each pair converge in a direction outwardly of said enclosure and the pairs of speakers being mounted in such side by side relation that the sounds from the respective speakers, each pair of which is adapted to transmit sounds from a single channel, blend to produce substantially a single wave length of sound in the low frequency range.

6. A bass speaker enclosure for use in a stereo system supplying multi-channel amplified sound deriving from a stereo production, comprising a housing, panels forming a closure to one side of said housing, said panels being paired in a side by side angular relation and mounting bass drivers paired in side by side corresponding angular relation so the central axes of the side by side bass drivers on the paired panels converge and intersect forwardly of said enclosure, said pairs of angularly related side by side panels being in a side by side continuous relation, each pair of panels mounting a set of drivers exclusively associated with a selected channel of the stereo production and connected exclusively to receive and transmit sound waves in a prescribed low frequency range.

* * * * *